US006371872B1

(12) United States Patent
Daley

(10) Patent No.: US 6,371,872 B1
(45) Date of Patent: Apr. 16, 2002

(54) LATERAL POSITIONING AND RECYCLING TABLE TENNIS ROBOT

(76) Inventor: Westphal Daley, 68 Simpson St., Hartford, CT (US) 06112

( * ) Notice: Subject to any disclaimer, the term of this patent is extended or adjusted under 35 U.S.C. 154(b) by 0 days.

(21) Appl. No.: 09/637,157

(22) Filed: Aug. 14, 2000

(51) Int. Cl.[7] ..... A63B 69/00
(52) U.S. Cl. ..... 473/460; 124/56; 124/48
(58) Field of Search ..... 473/422, 431, 473/432, 436, 459, 460, 462; 124/56, 51.1, 82, 78, 48

(56) References Cited

U.S. PATENT DOCUMENTS 3,794,011 A * 2/1974 Newgarden, Jr. ..... 124/78
3,878,827 A * 4/1975 Newgarden, Jr. ..... 124/51.1 X
3,911,888 A * 10/1975 Horvath ..... 124/56
4,765,618 A * 8/1988 Daley ..... 473/431
5,533,722 A * 7/1996 Lu ..... 473/460
5,607,151 A * 3/1997 Daley ..... 124/78

* cited by examiner

*Primary Examiner*—Raleigh W. Chiu

(57) ABSTRACT

A table tennis practice system comprised of a robot and an enclosure or recycle net which catches balls returned by a player. The robot propels balls fed to it at a set rate so that a player on the other end of the table can receive practice similar to that between humans. The robot and recycle net are constructed so that the robot may be placed anywhere between the sides of one end of the table while simultaneously retrieving and recycling balls returned by a player. This lateral mobility of the robot permits serves from the corners of the table or any point between. Its recycle system does not rely on air movement for ball transportation, hence there is improved reliability. The timing system eliminates jamming when it can be caused by balls falling into the holes of perforated platters or notched wheels of timing devices at an in appropriate time.

1 Claim, 7 Drawing Sheets

FIG 7
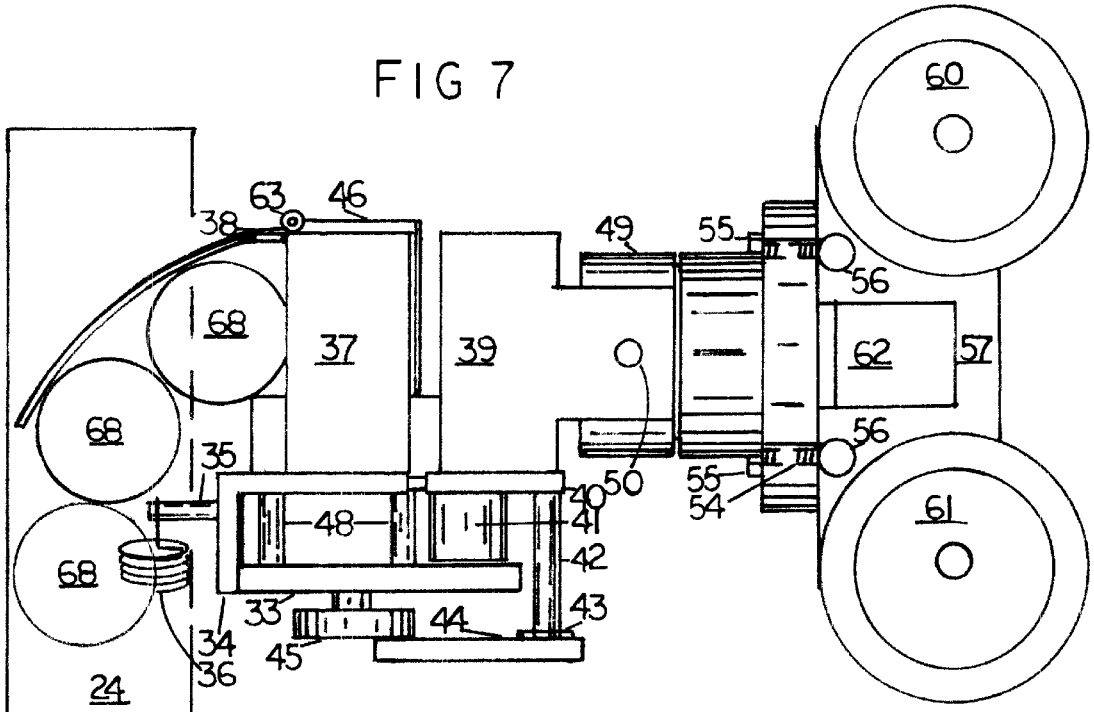
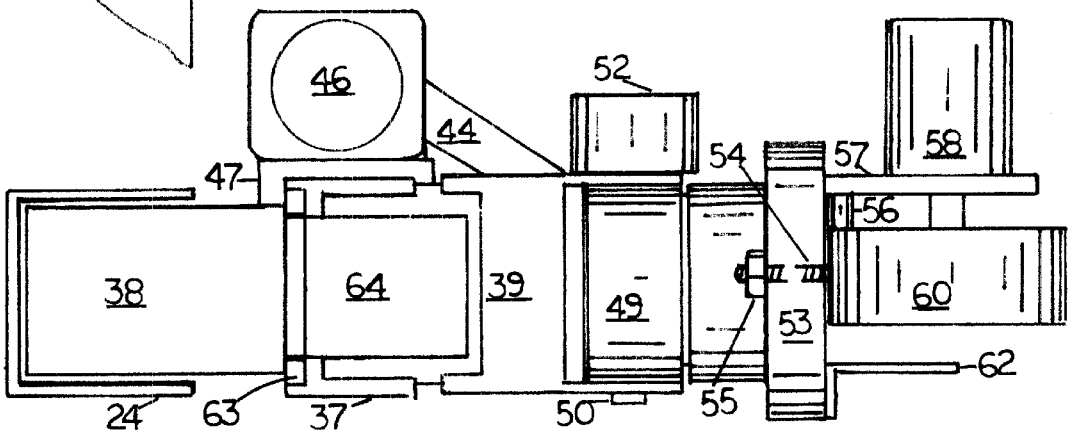
FIG 8

LATERAL POSITIONING AND RECYCLING TABLE TENNIS ROBOT

BACKGROUND

This invention is related to machines used by humans to simulate practice with another human partner in the field of sports. In this case, the sport is table tennis.

Prior robots have been invented for sports such as tennis, table tennis, baseball and soccer. However, recycle systems have only been known to have been attempted for table tennis. At least one ball collecting system was invented for tennis (see U.S. Pat. No. 4,116,436, Bjorhn, 1978) but since the balls are not returned to a robot after collection, it is not considered to be a recycle system. U.S. Pat. No. 4,077,386 by Berliner in 1978 and some other robots employ a recycle system.

The convenience of a recycle system is desirable when practicing with a robot. However, at the present state of the art, recycle systems are lacking in their ability to permit the head of the robot to be positioned so that it can serve from various horizontal angles. Past recycle systems required the robot to be set in a fixed position relative to the table. This position was usually halfway between the table sides. If a recycle system returns balls to the robot via a flexible hose as in U.S. Pat. No. 4,765,618, the robot may be positioned at any suitable point between the table sides. This permits serves from various horizontal angles. Another way to do this is to omit a recycle system and feed the robot from a hopper. In the case of the hopper, it is part of the robot and therefore goes where the robot goes.

Although the hose system mentioned above works, it has inherent problems. The hopper also works, but there is no recycling.

Another problem on some earlier robots was jamming. The method of supplying balls to the head at a set rate was often achieved by rotating a notched wheel or perforated platter to convert from a multiplicity of balls to a single ball. The conversion allows successive single balls to be fed into the head. These methods often caused jamming because there is no guarantee that balls will fall into notches or perforations at the right time and place. The result is that balls sometimes get caught between fixed and moving surfaces of the ball container, thereby causing a jam.

Now, let us return to the problems encountered when a flexible hose is employed as a ball transportation path. In U.S. Pat. Nos. 4,559,918 and 4,765,618, the point-of-entry of balls returned to the system is a fixed trough or pan. The flexible hose permits variable lateral positioning of the robot's head and a minimum hose length is required to cover positions over the entire width of the table.

The energy required to return balls to the head in the foregoing robots is supplied by an electric fan, which causes the balls to travel up the hose or tube under the force of air pressure or vacuum. The length of hose or tube and the airflow speed determine the recycle time of the system. This time is the time required to retrieve a returned ball and send it to the head. If this time is relatively long, the system is unable to keep up with the rate at which balls need to be served. This limitation can only be overcome by employing a more powerful energy source, which means a larger fan and more powerful motor. In practice, a more powerful source tends to be impractical because far more noise is generated and electrical energy requirement is highly increased.

Yet another problem with air feed systems, is that when the travel of balls up the hose or tube is not uniform, a situation sometimes arises where the balls pile up and inhibit further travel. This inhibition is due to the inability of the air supply to overcome the weight of a few balls at pile up. The result is that recycling ceases.

This invention permits the head of the robot to be placed at any position between the sides of the table without employing an air recycle system. Also, it eliminates jamming of the balls in the feed system. The mobility of the head allows the operator to receive serves from any angle and eliminates the need for a separate ball container.

SUMMARY

The table tennis robot can be clamped to one end of the table at any available position between the sides of the table. A disk at the lower extremity of the robot forces the elastic bottom of the recycle net downward to form a conical trough at whatever position is chosen along the length of the net. Balls entering the recycle net enclosure are caught and roll down the incline of the trough, stopping on the disk. The balls are jostled about the disk by a rotating square platter and one by one they are lifted by an arm which is attracted by magnets affixed to a rotating wheel. This wheel clutches a lifted ball and carries it into a channel where it stops. When the wheel carries another ball it pushes the first ball further up the channel. The cycle continues and eventually the channel is filled with balls to the point where they arrive at the head of the robot. The head of the robot propels the balls one at a time onto the playing area so that a player can obtain practice. The rate at which the balls are propelled is dependent on the rotational speed of the wheel with magnets.

Provision is made for tilting the head of the robot to permit serves at different vertical angles. Also, the head of the robot may be oscillated in an arc of the horizontal plane and the height of the head maybe adjusted as desired.

BRIEF DESCRIPTION OF DRAWINGS

FIG. 7 is a side view of the upper section of the robot. It includes the head and parts of the ball transportation path.

FIG. 8 is a plan of the section shown in FIG. 7.

DESCRIPTION

Figure 1:
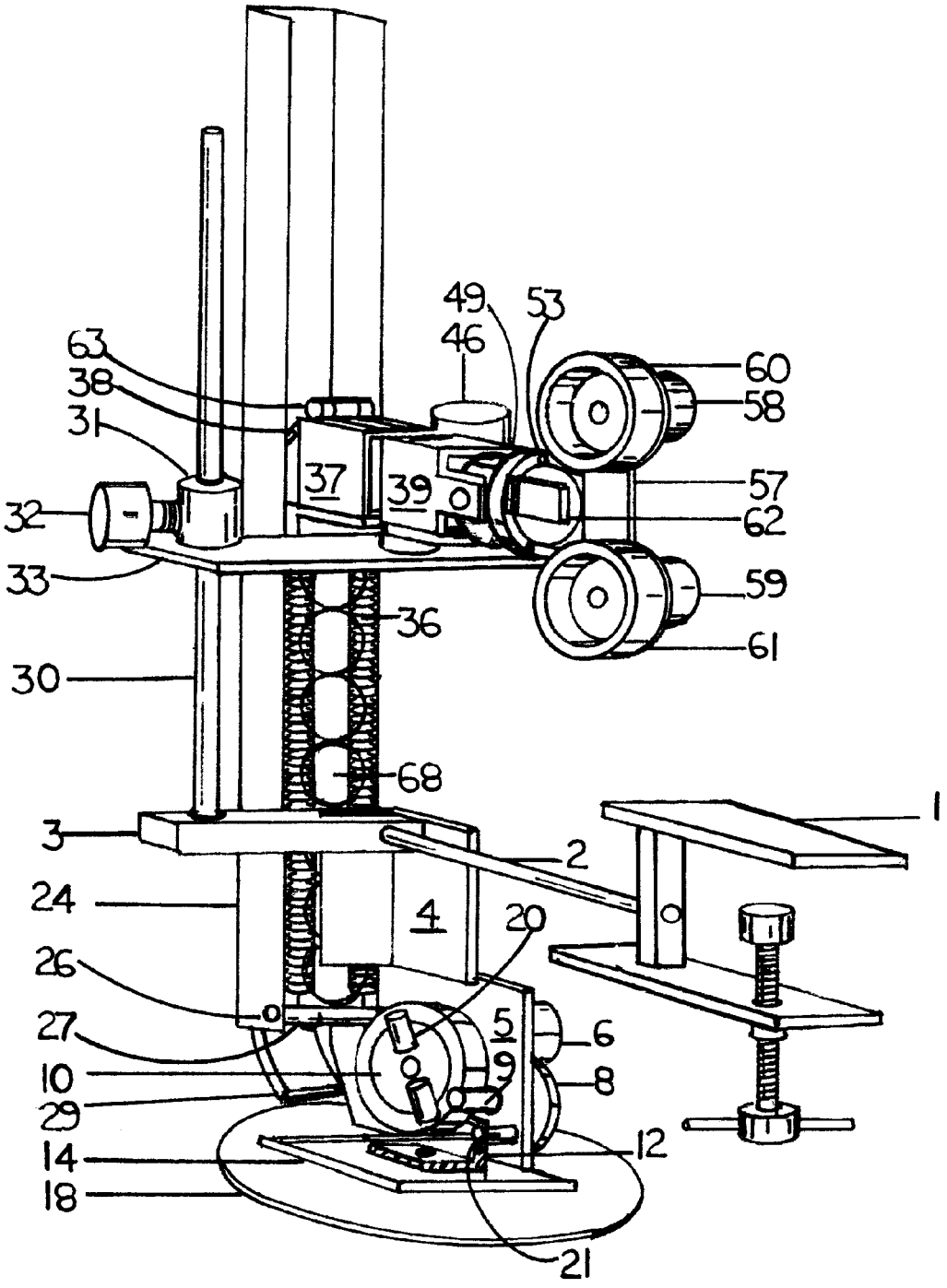
FIG. 1 is a perspective view of the robot.

In FIG. 1, screw clamp 1 is connected via cylindrical bar 2 to rectangular bar 3. Ninety-degree plate 4, which is connected to bar 3, suspends the lower section of the robot. The components on plate 5 comprise the lower portion of the robot and will be called the retrieval system throughout this description.

Figure 4:
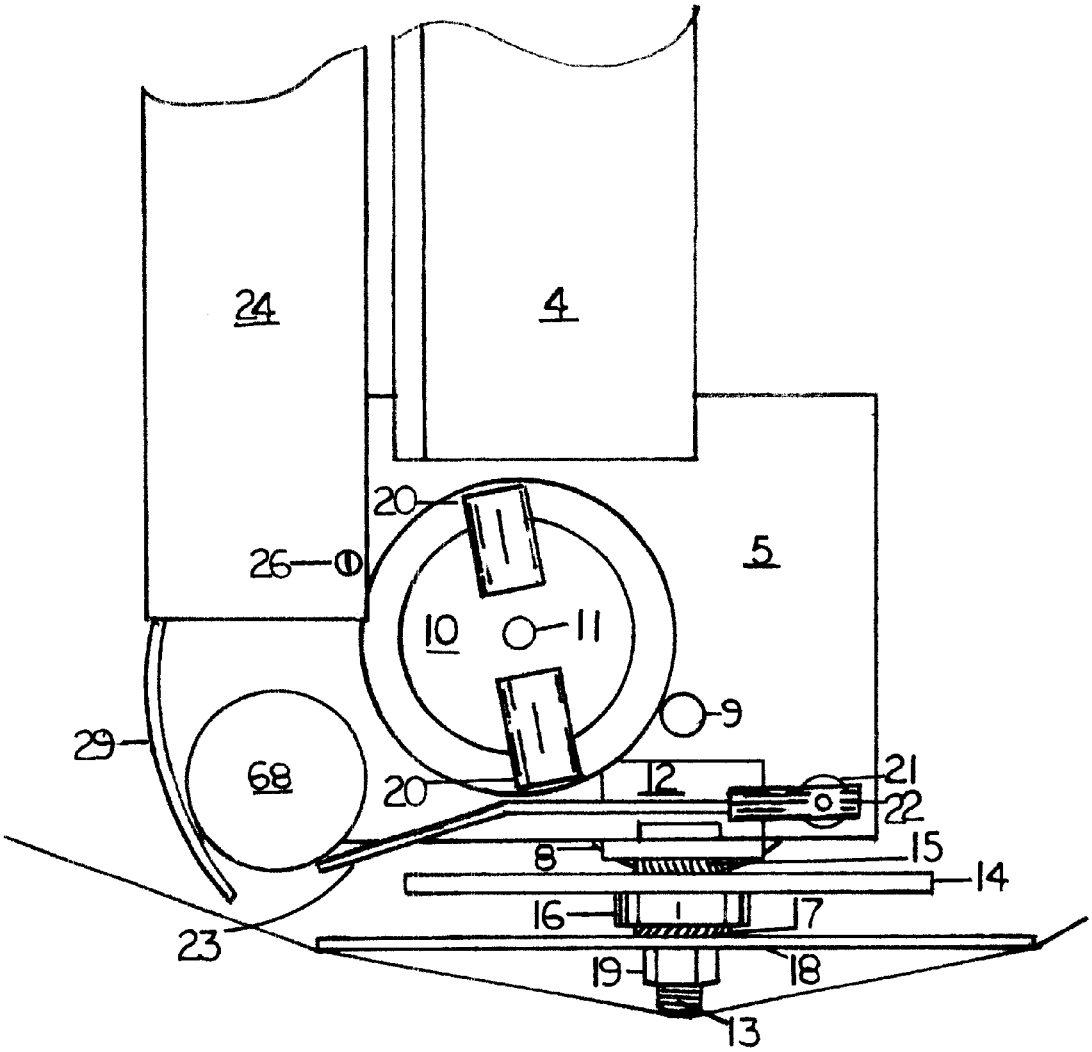
FIG. 4 is a side view of the lower or ball retrieval section of the robot.
Figure 5:
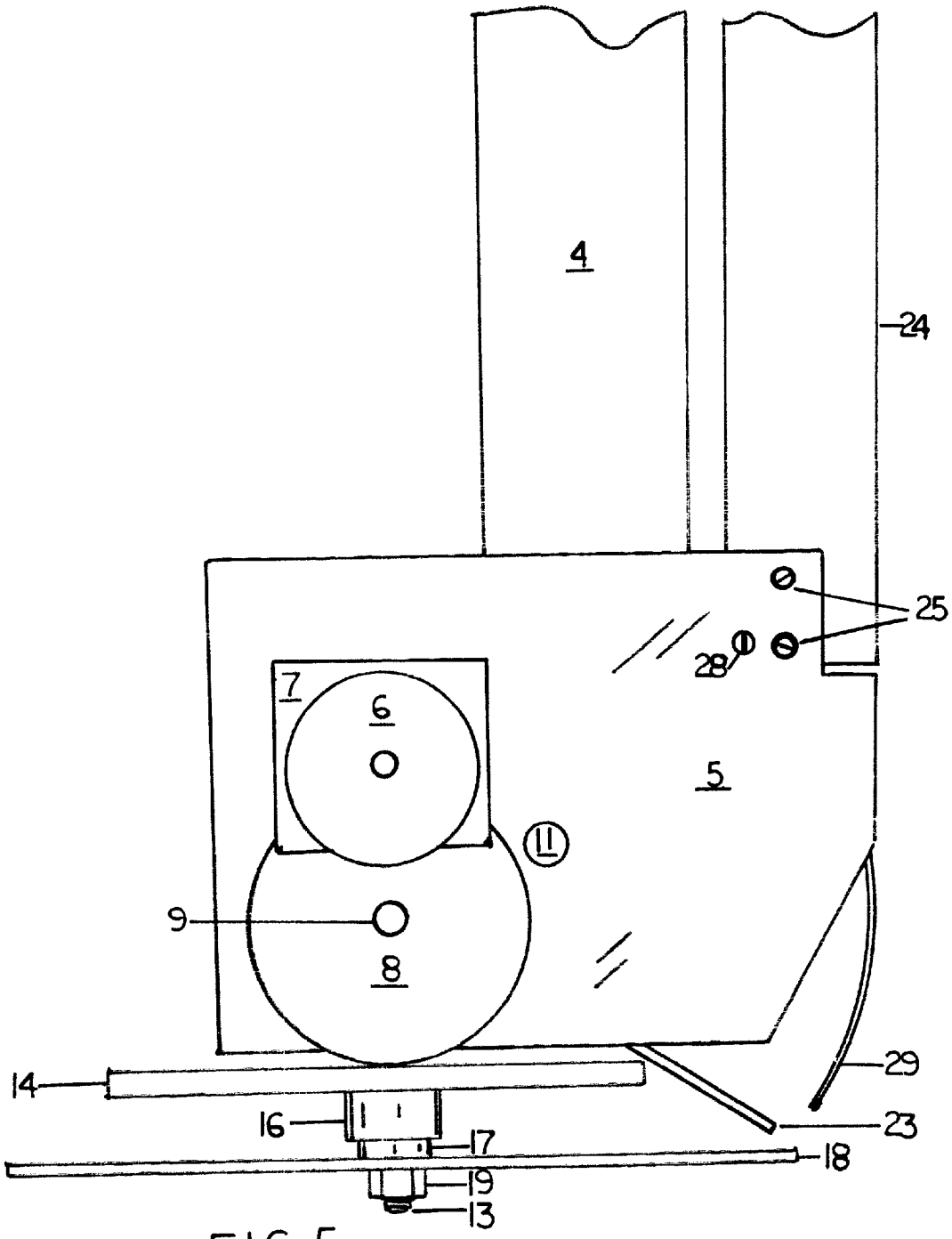
FIG. 5 is the opposite side view of FIG. 4.
Figure 6:
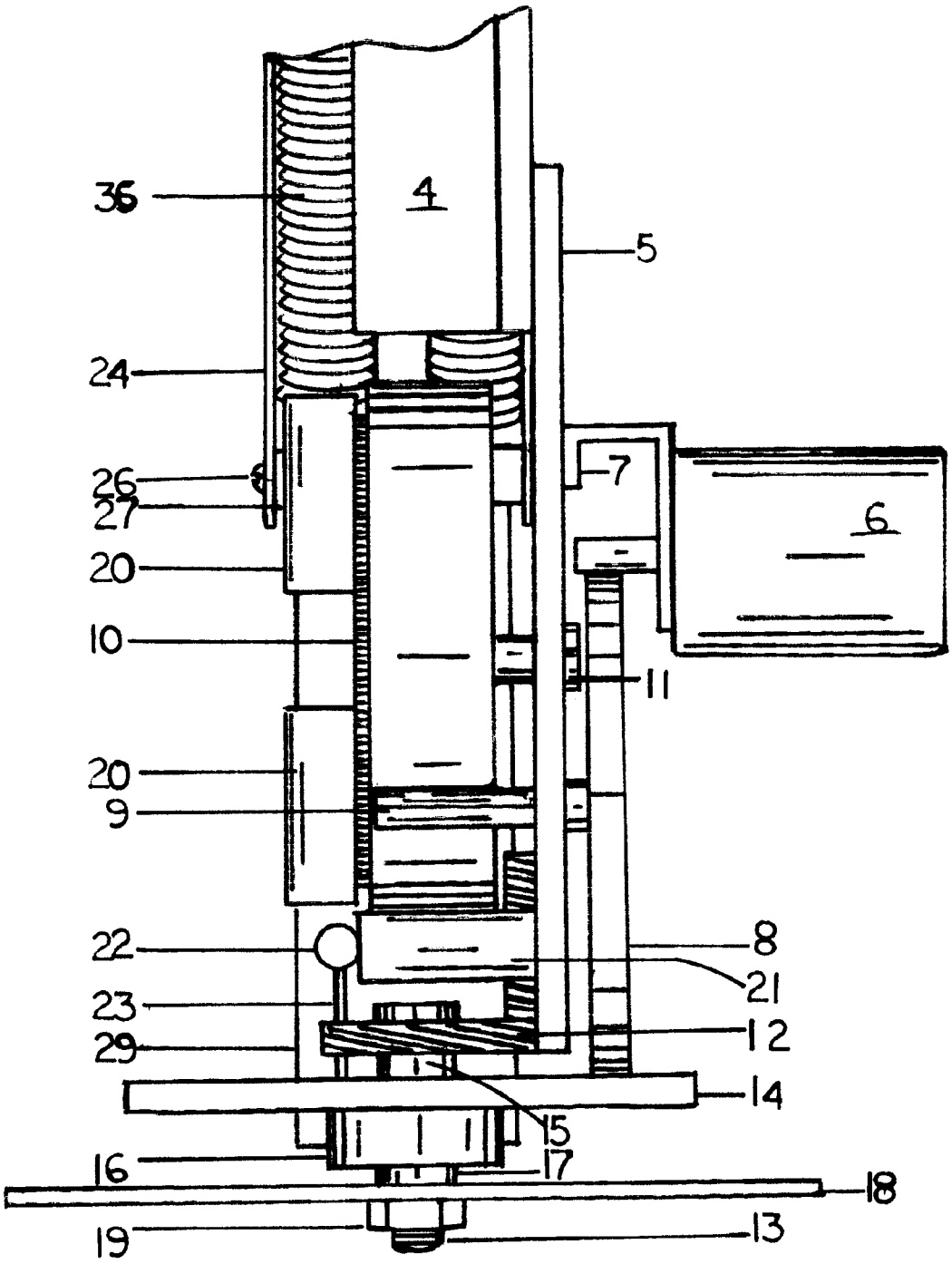
FIG. 6 is a front facing end view of the ball retrieval section of the robot.

The components of the retrieval system are shown in FIGS. 4,5,6. Electric motor 6 is mounted on plate 7(FIG.

5,6). Plate 7 positions motor 6 so that its shaft engages wheel 8 at its periphery. The shaft 9 of wheel 8 goes through a bushing in plate 5 and protrudes on the other side of the plate. The protrusion of the shaft engages rubber-rimmed wheel 10 at its periphery. Wheel 10 is mounted on shaft 11, which is affixed to plate 5. Ninety-degree angled plate 12 is connected to plate 5. A screw, 13, going through a hole in 12 also goes through the following components; spacer 15, ball bearing 16, spacer 17, and disk 18. When the nut 19 is threaded onto screw 13, the preceding four components are held firmly onto plate 12. Plate 14 is free to rotate on bearing 16, since spacers 15, 17 isolate the outer race of bearing 16 from the fixed surfaces of plate 12 and disk 18. Bearing 16 is press-fitted into plate 14 and therefore permits its rotation. In FIGS. 5, 6, it is seen that wheel 8 also engages plate 14. This engagement is such that contact from wheel 8 is in an area of plate 14 where a complete circle centered about the center of plate 14 can be rotated by wheel 8. Disk 18 cannot rotate, because the force of nut 19 presses it onto spacer 17, the inner race of bearing 16, spacer 15 and plate 12.

In FIGS. 4, 6, a cylindrical post 21 is attached at one end to plate 5. The other end provides a pivot for lever 22. An iron rod 23 is rigidly inserted into lever 22. Two cylindrical magnets 20 are affixed to wheel 10 and oriented so that a pole of each, faces out from the center of wheel 10, and is close to, but within the periphery of wheel 10.

A three-sided channel 24 is connected by screws 25 to plate 5(FIG. 5). Also, in FIGS. 1, 4 another screw 26 holds channel 24 onto a cylindrical post 27. The length of the post is the width of the channel, and its other end is attached to plate 5 by screw 28. A curved plate 29, which has a ninety-degree bent section for mounting, is connected to plate 5 by screws 25.

A cylindrical post 30 is affixed at one end into rectangular bar 3 so that its length runs parallel to channel 24. A collar 31 fits over rod 30 and is able to slide along the rod. Set-screw 32 locks the collar onto rod 30 at any height desired.

Plate 33 supports the upper section of the robot by way of its connection to the bottom end of collar 31. The views of FIG. 7, 8 omit the post and collar 30, 31 in order to provide a clearer view of the components on plate 33. If FIG. 7 is compared to FIG. 1 it can be seen that side view FIG. 7 is the side nearest collar 31.

Figure 9:
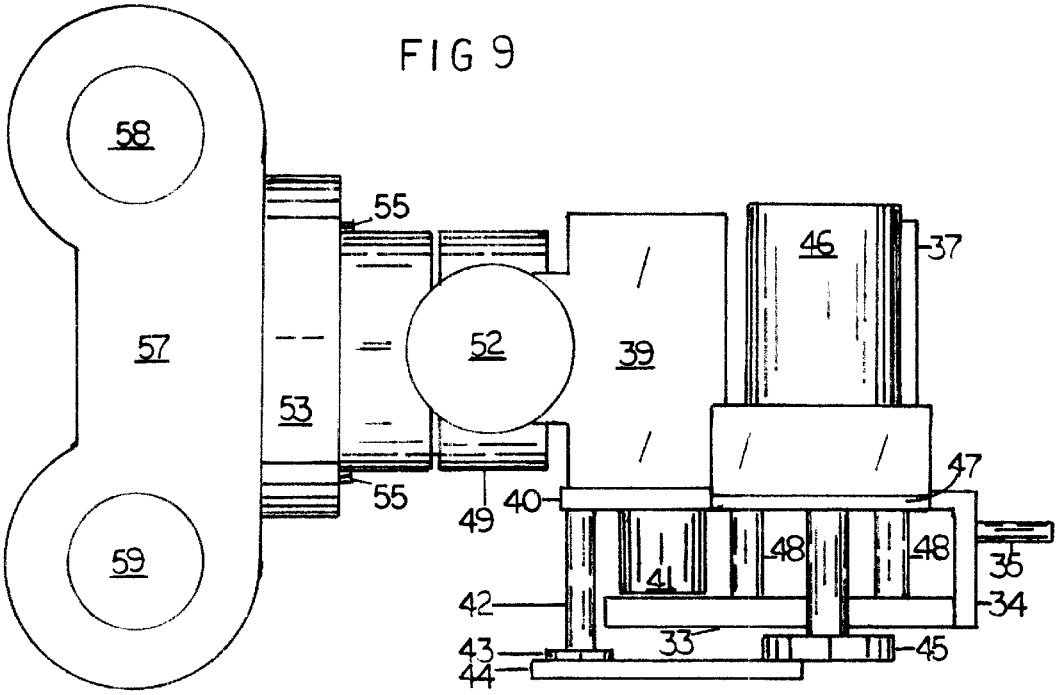
FIG. 9 is an opposite side view of FIG. 7.

On plate 33, a ninety-degree angled plate 34 is connected to one end of plate 33(FIGS. 7, 9). To this is affixed two posts 35(one visible). Coil springs 36 are attached to each post 35 and their other ends are connected to post 27 FIG. 1. Also mounted on plate 34 is a rectangular section of square tubing 37. Section 37 is oriented so that one open end faces the trough of channel 24. A curved metal plate 38, which is attached to section 37, protrudes into channel 24. The other open end of section 37 faces a similar open end in another rectangular section of square tubing 39. Section 39 can be described as a rectangular box, which has two open ends, and the vertical sides of the box are extended away from the box as shown in FIGS. 1, 7, 8. Section 39 is attached to plate 40. Plate 40 is attached to a ball bearing and its holder 41 whose shaft is affixed vertically into plate 33. A cylindrical post 42 is connected to one end of plate 40 and its other end fits into a bearing 43 which is pressed into connecting rod 44. The other end of 44 is connected to an eccentric 45. Eccentric 45 is fitted to the output shaft of gearmotor 46, which is connected to plate 47(FIG. 9). Plate 47 is mounted onto posts 48(FIGS 8, 9) which are connected to plate 33.

The extended vertical sides of section 39 support a cylinder 49 which is pivoted about its diameter on shafts 50, 51 which go from the cylinder through holes in the extended sides (FIG. 1,7). The shaft 51, is not visible on the drawing, however, its placement and operation are similar to shaft 50 except that shaft 51 is longer than shaft 50, and the length that protrudes outwardly from its supporting arm, is threaded. Knob 52 is threaded onto shaft 51, FIG. 8. If knob 52 is tightened on to the supporting arm of shaft 51, cylinder 49 is pulled tight against the arm. If it is adequately tight, cylinder 49 is fixed. Cylinder 49 can rotate about its pivots, if it is not held tightly by knob 52.

In FIG. 7, a flanged cylinder 53 is shouldered (shoulder not visible) on one end so that it fits into cylinder 49. Screws 54 and nuts 55 connect posts 56 to the flanged end of cylinder 53. In FIGS. 7, 8 the screws are exposed for clarity. The nuts in FIGS. 7, 8 are partially into cylinder 53. Plate 57 is connected to posts 56 as shown in FIG. 8(one shown). Electric motors 58, 59 are mounted onto plate 57. The motors have wheels 60, 61 fitted to their shafts. These motors are arranged so that at the closest proximity of the peripheries of the wheels they carry, a table tennis ball, introduced between them, is slightly compressed. The arrangement of the gap between both wheels is such that a ball traveling from left to right through cylinder 53 will go into the gap. A ninety-degree angled plate 62 confines the ball so that it can go only into the gap between wheels 60, 61. In FIG. 7, 8 hinge 63 is connected atop section 37. It carries a flap 64 whose unconnected end falls and orients the length of the flap in a vertical plane.

Figure 2:
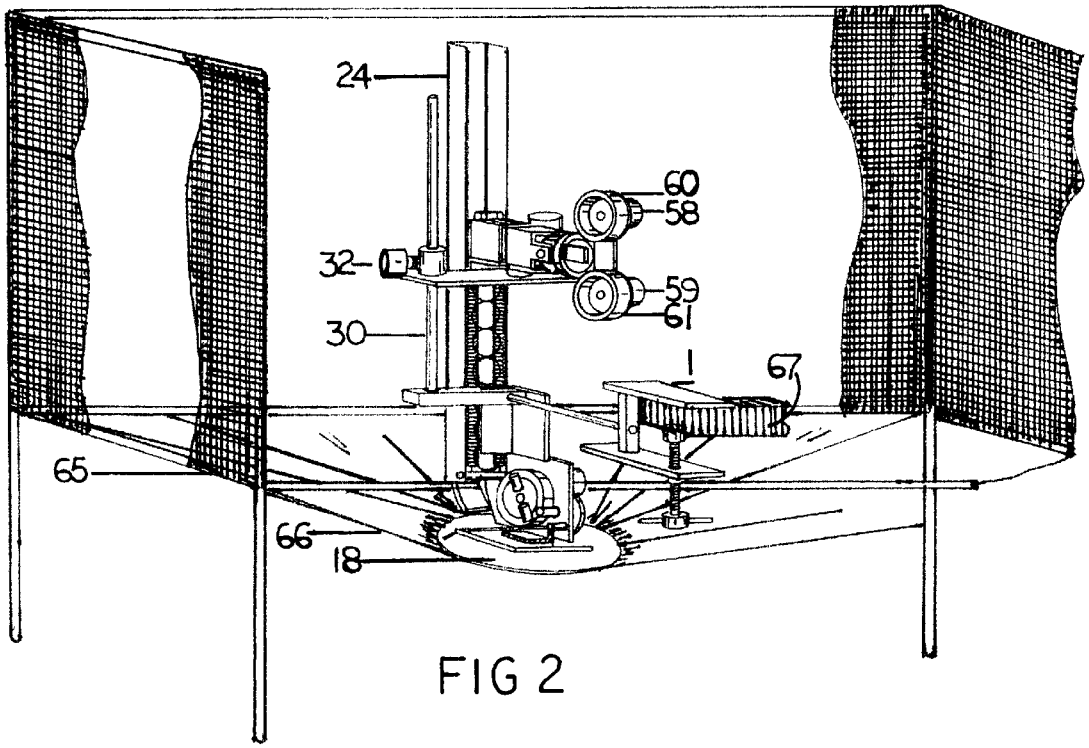
FIG. 2 is a cut-away perspective view of the collection net and the robot as in FIG. 1. A small cut-away of the table is shown in the clamp of the robot.
Figure 3:
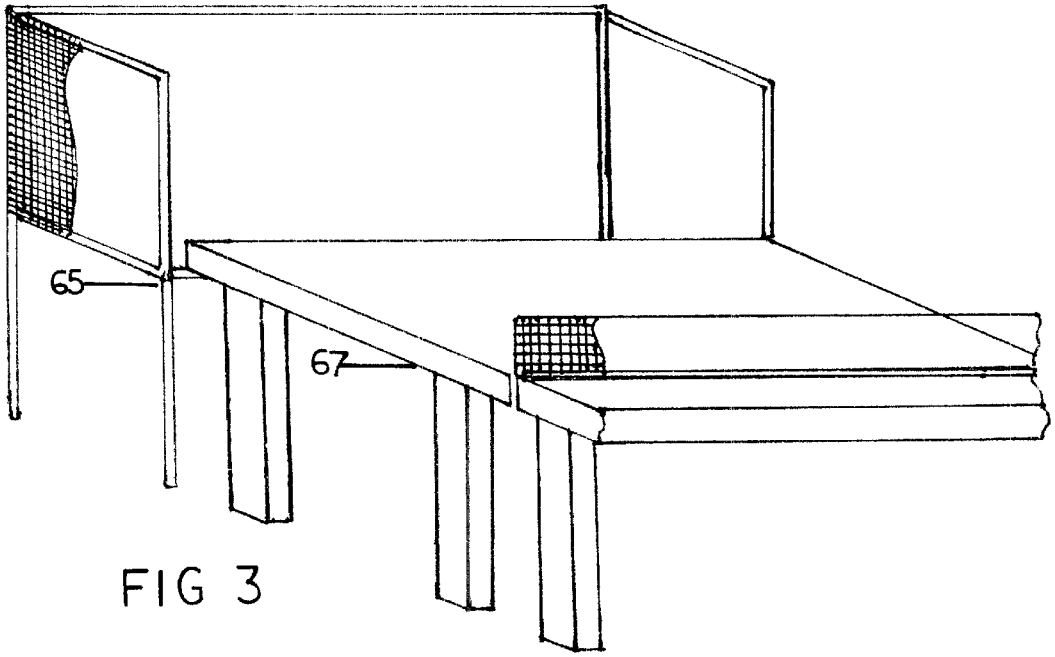
FIG. 3 is a cut-away perspective view of the collection net and the table. It establishes the relationship between the table, collection net and robot, when viewed in conjunction with FIG. 2.

In FIG. 2, the recycle net and frame 65 are shown. The net is made of cloth. The robot in FIG. 1 is seen with a small cut-away of the end of the table top within the clamp 1. The purpose of this figure is to show that the horizontal or bottom section 66 of the recycle net is depressed when the robot is clamped to the table. When this happens, disk 18 forces section 66 into a partially conical depression. The table is cut-away to give a clear view of the bottom of the recycle net. Section 66 is made from elastic material.

FIG. 8 shows the position of the recycle net relative to the table 67 and by association, the robot to the recycle net.

Figure 10:
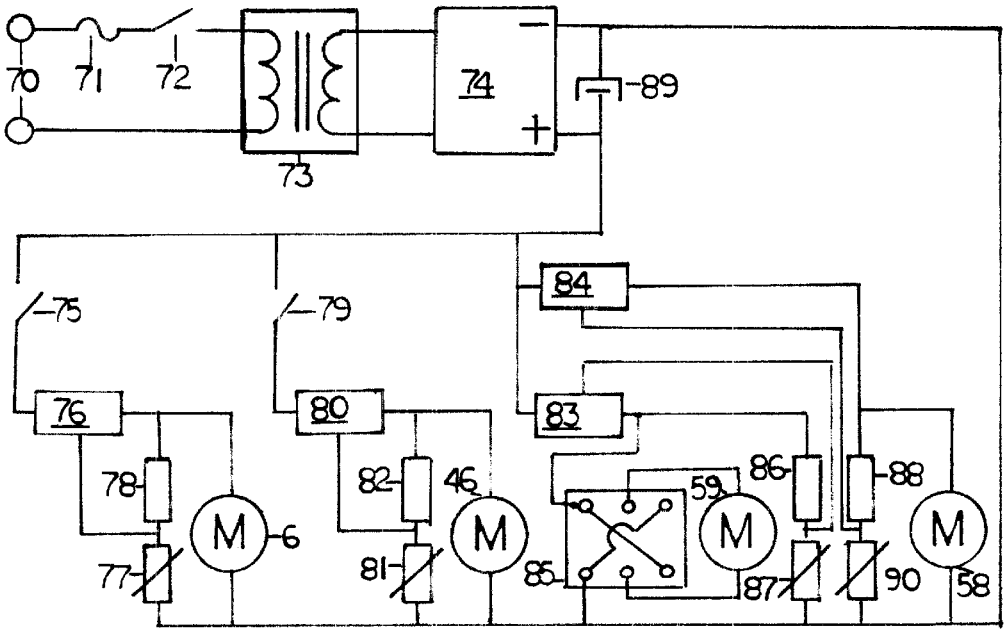
FIG. 10 is a schematic of the electrical power supply and remote control, which powers the robot.

The robot is powered by an electrical power supply and remote control unit. The circuit is shown in FIG. 10. Commercial power in the order of 100 volts enters at 70 of FIG. 10. When switch 72 is closed, alternating current flows through fuse 71 and the left winding of transformer 73. The right side secondary of transformer 73 has approximately 12 volts induced across its winding. This alternating voltage will cause an alternating current (AC) to flow, and bridge rectifier 74 converts the AC to direct current (DC). The robot's motors require DC at a maximum of 12 volts. Capacitor 89 improves the quality of DC by reducing ripple. The positive output of rectifier 74 supplies voltage to switch 75, 79, voltage regulators (VR) 83, 84. The four motors employed are 6, 46, 59, 58. They are powered and controlled by VR 76, 80, 83, 84 respectively. When power switch 72 is closed, power is available to the entire circuit. If switch 75 is subsequently closed, 12 volts is supplied to VR 76. Fixed resistor (R) 78 and motor 6 are both directly connected to the output of VR 76. The other end of motor 6 is connected to the minus or (−ve) of the power supply. Resistor 78 and variable resistor 77 comprise a voltage divider which determines the output voltage of VR 76 and hence the rotational speed of motor 6. The circuit of motor 46 operates in an identical manner to that of motor 6. The corresponding components are switches 75, 79, resistors (R) 78, 84, and variable resistors (RV) 77, 81.

The circuit of motor 59 receives power whenever the unit is powered up. The direction in which motor 59 rotates is determined by switch 85, which is on the output of VR 83. Switch 85 is a double pole, double throw type. The positive (+ve) voltage from VR 83 is supplied to a pole of switch 85. The −ve terminal of the power supply is connected to the other pole on the same side or throw of switch 85. The terminals of motor 59 are each connected to a separate common pole of switch 85. The pair of poles for the other throw of switch 85, are cross-connected to the +ve and −ve poles so that when a second throw of switch 85 is made, the terminals of motor 59 are supplied the opposite polarity of the first throw. R 86 and RV 87 in the circuit of motor 46, have the same function as R 75, RV 77 in the circuit of motor 6.

The circuit of motor 58 functions identically to those of motors 6, 46 with the exception that its VR 84 is directly connected to the +ve of the power supply. There is no individual switch. Fixed resistor R 88 and variable resistor RV 90 function identically to R 75 RV 77.

Description of Operation

The robot may be clamped onto the end of the table by adjusting the screw on clamp 1 after the robot has been placed in the desired position on the table. Disk 18 presses down on the bottom elastic section 66 of the recycle net. A partial cone is formed in the bottom.

The robot can be positioned almost anywhere on the table-end and the conical shape will be realized.

When balls are thrown into the enclosure of the recycle net, they roll down the incline of the cone and stop on disk 18. When motor 6 is operated, wheel 8 is rotated and this causes square plate 14 to rotate clockwise (FIGS. 5,6). This action causes the corners of plate 14 to jostle the balls around. Eventually, a ball 68 (FIG. 4) stops between wheel 10, curved plate 29 and plate 5. In this stopped position, the ball is resting on top of rod 23. Wheel 10 is driven to rotate by shaft 9 so it rotates clockwise (FIG. 1,4). Soon, one of the magnets 20 approaches iron rod 23 and the magnet attracts it. The rod is carried upward, and carries the stopped ball up along the curved plate 29 and into the gap between wheel 10 and mid-section of channel 24. The ball is therefore clutched between wheel 10 and the mid-section of channel 24. The clutching action is brief since only a small section of the channel faces wheel 10. During the clutching action, the ball is carried further up the channel. When the ball is no longer clutched, it remains in the channel and is prevented from falling because wheel 10 is still rotating.

While rod 23 was carrying the ball upwards, it also prevented jostled balls from entering the space formerly occupied by the ball. Rod 23 is stopped on post 27 so that the magnet releases it and it falls back to its rest stop on disk 18. At this point, another jostled ball can go into the space formerly occupied by the first ball. The other magnet on wheel 10 comes around, lifts rod 23 and the second ball up into the wheel-and-channel gap. The second ball pushes the first further up the channel. The cycle of lifting balls continues as long as motor 6 operates. Eventually, the channel is filled with balls up to plate 38. The balls are pushed along curved plate 38 at the top of the channel (FIG. 1,7) and enter square tube section 37. There, flap 64 is lifted about the hinge 63 and the balls go across the gap between section 37, 39 into square section 39 then through cylinders 49, 53 and out to the gap between propulsion wheels 60, 61. If wheel 60 is rotating counterclockwise, the first ball will be propelled from the robot with some spin and at a speed, which is proportional to the wheel's rotational speed. If wheel 61 rotates clockwise, the ball would also be propelled with the same results except that the ball would spin in the opposite direction. If both wheels rotate simultaneously so that 60 rotates counterclockwise and 61 rotates clockwise, and their speeds are equal, then the ball would be propelled without spin. Various combinations of the speed of wheel 60, 61 can achieve various spins. This includes rotating both wheels in the same direction. However, in the latter case, a differential of wheel speeds must exist.

In FIGS. 7,8, it can be seen that if gearmotor 46 is operated, the eccentric 45 on its output shaft will transfer motion through the connecting rod to drop-arm 42, thereby causing oscillation of plate 40 about bearing 41. The result is that section 39 and the rest of components connected to its right will oscillate over an arc in the horizontal plane, thereby permitting angled serves. Balls are able to go across the gap from section 37 to section 39, because the opening on section 39 which faces 37, has minimal movement during oscillation. This is so because it is at a small distance away from the pivot 41. Set screw 32, post 30 and collar 31 permit adjustment of the height from which balls are propelled. Knob 52 (FIG. 8) permits tilt, thereby allowing propulsion of the ball through various vertical angles.

The hinge 63 and flap 64 comprise a relief valve. When the robot-head is adjusted to a lower height, less space is available in the channel, and so balls escape by forcing flap 64 upwards and out of sections 37,39.

What is claimed is:

1. I claim as my invention, a table tennis robot which is comprised of a ball propulsion and retrieval system working in conjunction with a ball collecting enclosure whose bottom is made from an elastic material, thereby permitting said propulsion and retrieval system to be moveable in a horizontal manner relative to the sides of one end of a table tennis table while simultaneously maintaining the position of said enclosure so that it catches balls returned by a player at the other end of said table; said balls returned, rolling down the incline of a conical trough which is formed in said elastic material by a horizontal disk connected to the lowest extremity of said propulsion and retrieval system; said balls returned being stopped on said disk and being jostled by a rotating square plate which is in close proximity to said disk; said balls returned falling one by one atop an iron rod within an enclosure which is comprised of a curved vertical plate attached to the lower end of a coil-spring-enclosed vertical channel, the mounting plate for said channel and the periphery of a rotating wheel which has magnets attached to its flat surface; said balls returned being lifted up one by one into the channel by the rod as the wheel rotates and carries the magnets so that one by one a pole on each magnet attracts the iron rod; said returned balls being lifted into the channel one by one, are clutched one by one between the wheel and a section of the channel so that the first ball entering the channel is pushed further up the channel by the second, the second is pushed by the third and so on, until the channel is filled to a point where the balls arrive at the head of the robot where they are propelled one by one.

* * * * *